United States Patent [19]

Perricone

[11] Patent Number: 4,995,477

[45] Date of Patent: Feb. 26, 1991

[54] SAFETY DEVICE FOR ELEVATORS

[76] Inventor: Ann Perricone, 6802 Ridge Blvd., Brooklyn, N.Y. 11220

[21] Appl. No.: 487,155

[22] Filed: Mar. 1, 1990

[51] Int. Cl.[5] ..... B66B 9/00

[52] U.S. Cl. ..... 187/1 R; 160/144; 52/473

[58] Field of Search ..... 187/1 R, 28, 62, 105; 49/74, 73, 87, 116, 122, 347; 160/130, 144, 138, 136; 52/473

[56] References Cited

U.S. PATENT DOCUMENTS 836,877 11/1906 Guess ..... 187/1 R 2,614,704 10/1952 Winslow ..... 187/1 R

FOREIGN PATENT DOCUMENTS 0203192 8/1989 Japan ..... 187/1 R

*Primary Examiner*—H. Grant Skaggs

*Assistant Examiner*—Kenneth Noland

*Attorney, Agent, or Firm*—Goodman & Teitelbaum

[57] ABSTRACT

A safety device for elevators including at least one overhead panel to provide an overhead compartment within an elevator car, and rope-like members being stored within the overhead compartment prior to use thereof, each rope-like member being secured at one end to a roof of the elevator car with the opposite free end thereof being provided with a foot supporting member. An opening mechanism is provided for opening the one overhead panel, and an actuating member is disposed within the elevator car for actuating the opening mechanism. When required, a passenger within the elevator car activates the actuating member to actuate the opening mechanism to open the one overhead panel so that the free ends of the rope-like members fall into the elevator car to permit the passengers to step into the foot supporting members to raise themselves above the elevator car floor.

12 Claims, 2 Drawing Sheets

SAFETY DEVICE FOR ELEVATORS

BACKGROUND OF THE INVENTION

The invention relates to elevators and, more particularly, to a safety device for elevators which can support the passengers above the floor of the elevator car when the elevator car floor is unsafe or undesirable to stand upon by the passengers.

In general, elevators have been proven safe and accommodating, where the number of accidents reported have been significantly small compared to the enormous use of the elevator. Due to this low accident rate, no provision has been made in elevators to protect the passenger in case the elevator car floor should be broken or in disrepair, or should be flooded with water such as during a fire when the passengers are trapped in the elevator and the firemen are pouring water into the building to put out the fire.

The need for a safety device for the passengers of an elevator was recognized in U.S. Pat. No. 836,877 and British Patent No. 829,172. These patents disclose an elevator safety device including means such as rods, bars or ropes mounted in the elevator car above the heads of the passengers so as to extend substantially horizontally between two opposing walls of the elevator car within an overhead reach of the hands of the passengers. Accordingly, should the elevator car begin to fall out of control, the passengers would reach up with their hands and grasp unto the rods, bars or ropes, and then raise their feet above the floor of the elevator car, so that when the elevator car is subsequently brought to a sudden stop, as on reaching the bottom of the elevator shaft, the passengers' legs are protected from the shock produced by the sudden stop.

Accordingly, there is a need in the elevator art to provide a safety device when the floor of the elevator car is unsafe or undesirable to stand upon by the passengers, where such a device should be able to accommodate all the passengers in the elevator car without requiring the passengers to be physically fit in order to raise their feet from the floor of the elevator car.

SUMMARY OF THE INVENTION

It is accordingly an object of the present invention to provide a safety device for elevators, when the elevator car floor is unsafe or undesirable to stand upon by the passengers, which avoids the problems of the prior art.

Another object of the present invention is to provide a safety device for elevators, as mentioned above, to adequately support the passengers above the elevator car floor.

A further object of the present invention is to provide a safety device for elevators, as mentioned above, which is reliable, has few moving parts, and is not subject to the passengers being physically fit.

Still another object of the present invention is to provide a safety device for elevators, as mentioned above, which is simple, and can be easily manufactured and installed in existing elevators.

A further object of the present invention is to provide a safety device for elevators, as mentioned above, which includes rope-like means having foot stirrups which can receive the feet of the passengers so that the passengers can raise themselves from the floor of the elevator car.

Another object of the present invention is to provide a safety device for elevators, as mentioned above, which includes an overhead compartment within the elevator car for storing the rope-like means when not in use.

And yet a further object of the present invention is to provide a safety device for elevators, as mentioned above, which includes means for opening panels of the overhead compartment so that the rope-like means can be released from the overhead compartment when required and placed in use for the passengers.

Another object of the present invention is to provide a safety device for elevators, as mentioned above, wherein the rope-like means includes a pair of rope-like members each having a stirrup at one end thereof for each passenger so that the passengers can step into the stirrups and hold tightly onto the rope-like members with the passengers' feet being raised above the elevator car floor.

Briefly, in accordance with the present invention, there is provided a safety device for elevators, including overhead panels, preferably corrugated, installed in a conventional elevator car to provide an overhead compartment therein. The panels are opened by lever means which can be operated by one of the passengers when required. Rope-like means are stored within the overhead compartment, each of the rope-like means being secured at one end to the roof of the elevator car, with a foot stirrup being provided on the opposite free end of each of the rope-like means.

Accordingly, when required, one of the passengers pulls tho lever means to open the overhead panels so that the rope-like means are released from the compartment and the free ends thereof, with the stirrups thereon, fall into the internal space of the elevator car occupied by the passengers. The length of the rope-like means is predetermined so that the stirrups are sufficiently spaced above the elevator car floor. The passengers will then step into the stirrups, there being preferably two stirrups for each passenger, and hold tightly onto the rope-like means so that the passengers are raised above the elevator car floor The rope-like means includes a pair of ropes for each passenger with each rope having a stirrup on the free end thereof.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

In the various figures of the drawings, like reference characters designate like parts.

DESCRIPTION OF THE PREFERRED EMBODIMENT

Figure 1:
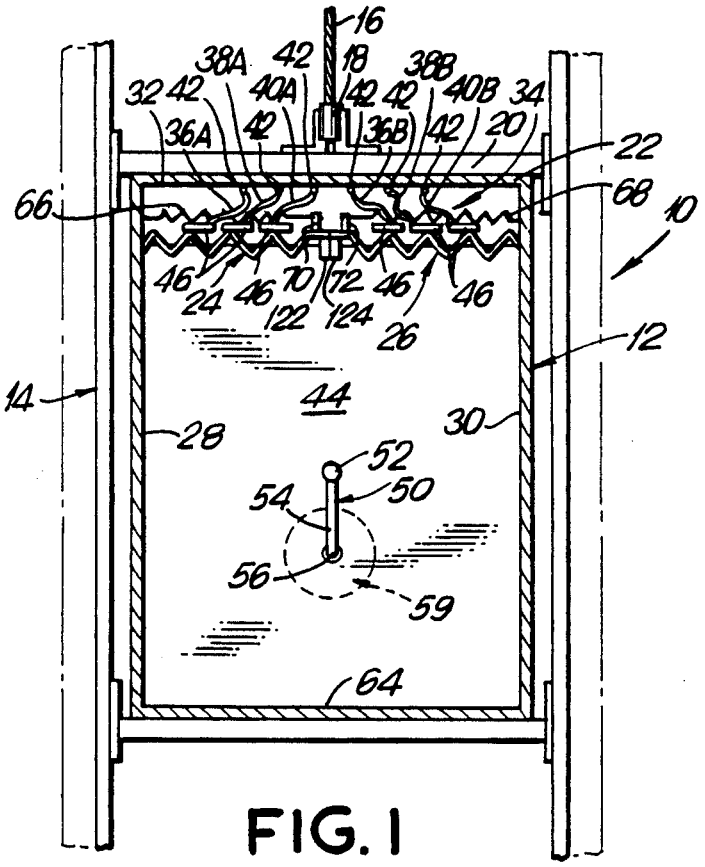
FIG. 1 is a cross-sectional elevational view, showing an elevator car provided with a safety device in accordance with the present invention, the safety device being positioned prior to use thereof.

Referring now to the drawings, FIG. 1 discloses a conventional elevator 10 including an elevator car 12 mounted for up and down movement within an elevator shaft 14. A conventional cable 16 is connected by conventional fastening means 18 to a support member 20 secured to the roof 22 of the elevator car 12 to provide for the up and down movement of the elevator car 12, which is well-known in the art.

In accordance with the present invention, a pair of overhead panels 24, 26, preferably corrugated, extend across an upper portion of the elevator car 12 from one side wall 28 to the opposite side wall 30 of the elevator car 12 to provide an overhead compartment 32 within the elevator car 12 to house and store the safety device 34 prior to the use thereof according to the present invention. However, it is noted that the pair of overhead panels 24, 26 can be replaced with a single overhead panel, if desired, with a minimum amount of modification thereto.

Figure 2:
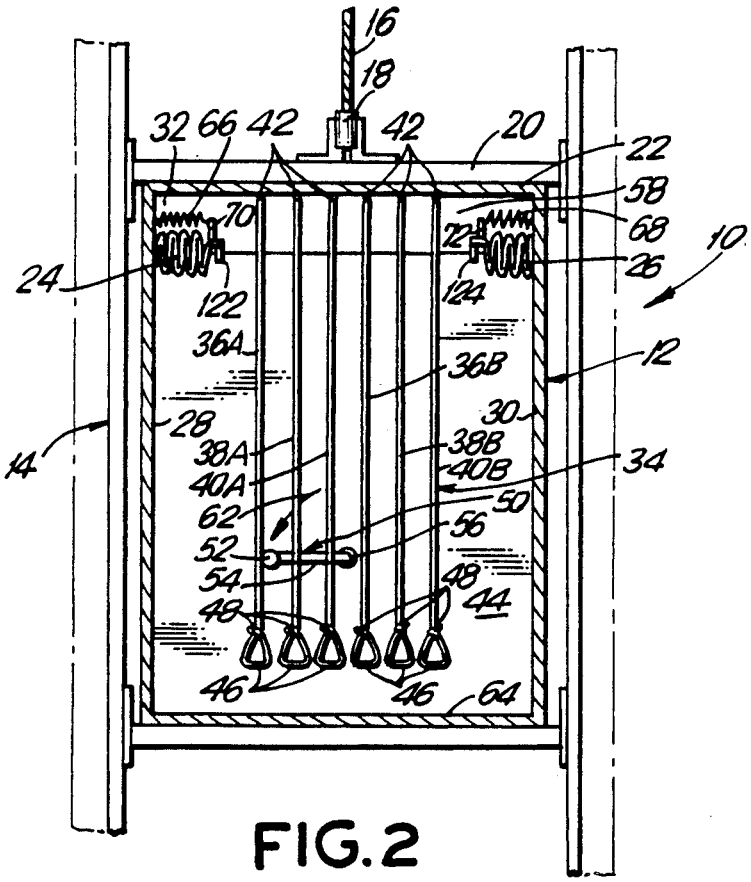
FIG. 2 is a cross-sectional elevational view similar to FIG. 1, showing the safety device in position for use thereof.

The safety device 34 includes rope-like means such as ropes, preferably arranged in pairs so that each one of the passengers would have his own pair of ropes. For example, as best shown in FIG. 2, one passenger would have the pair of ropes 36A, 36B, a second passenger would have the pair of ropes 38A, 38B, a third passenger would have the pair of ropes 40A, 40B, and so on so that the remaining passengers would also have their own pair of ropes to be used as set forth below. One end 42 of each of the ropes is secured in a conventional manner to the roof 22 of the elevator car 12.

It is noted, that each of the pairs of ropes are spaced apart from each other, from the rear to the front of the elevator car 12, to allow adequate space therebetween for each passenger, where it is obvious that more than the three pairs of ropes shown can be mounted in the elevator car 12. Accordingly, for example, the pair of ropes 36A, 36B would be secured near the rear panel 44 of the elevator car 12, the pair of ropes 38A, 38B would be secured in a central portion of the elevator car 12, and the pair of ropes 40A, 40B would be secured near the front of the elevator car 12. Obviously, if additional pairs of ropes are desired, these additional pairs would be secured in a spaced-apart like manner between the rear panel 44 and the front of the elevator car 12.

The opposite free end of each of the ropes is looped to form a stirrup 46 secured at 48. Obviously, if desired, a preformed stirrup can be connected to each free end of the ropes instead of forming the above-mentioned loop.

Actuating means, such as a handle 50, is disposed within the elevator car 12 at a selected position below the overhead panels 24, 26 to be within easy reach of the passengers. The handle 50 is shaped to include an upper gripping portion 52 extending towards the front end of the elevator car 12, an intermediate portion 54 extending at a right angle from the gripping portion 52, and a connecting portion 56 extending at a right angle from the intermediate portion 54 and parallel to the gripping portion 52 to extend through the rear panel 44 towards the rear wall 58 of the elevator car 12. The connecting portion 56 is connected to opening means 59 for opening the overhead panels 24, 26, as will be explained below.

Accordingly, when the elevator car floor is unsafe or undesirable to stand upon by the passengers, such as when the elevator car floor becomes broken or in disrepair, or becomes flooded with water as during a fire when the passengers are trapped in the elevator and the firemen are pouring water into the building to put out the fire, one of the passengers will grasp the gripping portion 52 of the handle 50 and rotate same in either a clockwise direction or in a counterclockwise direction, as shown by the arrow 62 in FIG. 2, in order to actuate the opening means 59 to open the overhead panels 24, 26. Once the overhead panels 24, 26 are opened, the ropes 36A, 36B, 38A, 38B, 40A and 40B will drop by gravity out of the overhead compartment 32 into the interior space of the elevator car 12, as shown in FIG. 2. The length of each of the ropes is predetermined, so that the stirrups 46 are spaced a predetermined distance, such as approximately one foot, from the floor 64 of the elevator car 12.

Accordingly, each of the passengers will select one of the pairs of ropes, and will then step into the stirrups 46 thereof so that each foot of the passengers is in a stirrup with each passenger's body being disposed between the ropes of the selected pair. The passengers will use the ropes to enable them to step into the stirrups 46, and then will hold tightly onto the ropes to maintain themselves in the raised position above the broken, disrepaired or flooded floor 64 of the elevator car 12.

The opening means 59 of the present invention as shown best in FIGS. 3–5 will now be described, where the mechanism shown is considered to be the best mode for carrying out the invention, however, it is understood that other modes can obviously be used.

Preferably, spring means are disposed within the overhead compartment 32 for opening the overhead panels 24, 26 when the panels 24, 26 are released. The spring means preferably include coil springs 66, 68. One end of the coil spring 66 is connected in a conventional manner to the side wall 28 of the elevator car 12, with the opposite end of the coil spring 66 being connected in a conventional manner to a bar member 70 extending upwardly from a forward portion of the overhead panel 24. Likewise, one end of the coil spring 68 is connected to the opposing side wall 30 of the elevator car 12, with the opposite end of the coil spring 68 being connected in a conventional manner to a bar member 72 extending upwardly from the forward portion of the overhead panel 26.

Figure 3:
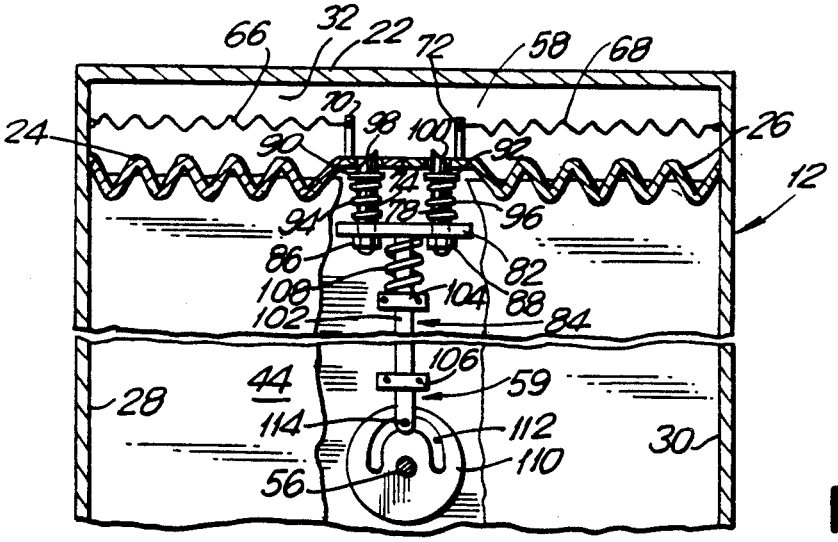
FIG. 3 is an enlarged fragmented cross-sectional elevational view of the elevator car, showing the mechanism for releasing and opening the overhead panels in the elevator car.
Figure 4:
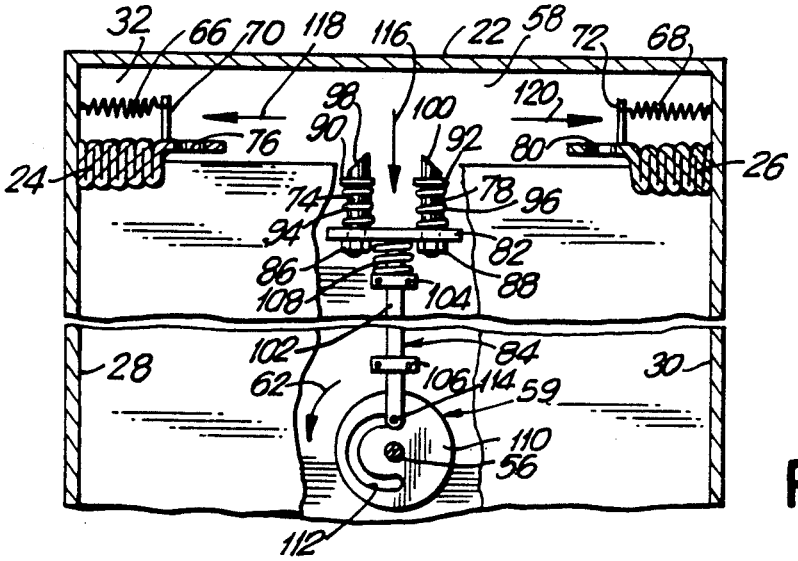
FIG. 4 is an enlarged fragmented cross-sectional elevational view similar to FIG. 3, showing the mechanism when the overhead panels have been opened.

When the overhead panels 24, 26 are opened, as shown in FIGS. 2 and 4, the coil springs 66, 68 are in an untensioned condition. When the overhead panels 24, 26 are in the closed position, as shown in FIGS. 1 and 3, the coil springs 66, 68 are in a stretched or tensioned condition so that the springs 66, 68 are exerting a force on the overhead panels 24, 26 trying to return the overhead panels 24, 26 to their opened position. However, a bar 74 is received in an opening 76 in the forward end of the overhead panel 24, and a second bar 78 is received in an opening 80 in the forward end of the overhead panel 26, so that the bars 74, 78 act against the return forces of the coil springs 66, 68 to maintain the overhead panels 24, 26, in the closed position, as best shown in FIG. 3.

The bars 74, 78 extend through holes in a transverse portion 82 of a T-shaped member 84, and are vertically movably secured thereto by nuts 86, 88, respectively.

Each of the bars 74, 78 is provided with a collar 90, 92 respectively, with the springs 94, 96 being disposed on the bars 74, 78 between the collars 90, 92, respectively, and the transverse portion 82 to maintain the bars 74, 78 in their uppermost positions, the function of the springs 94, 96 will be explained below. Additionally, the bars 74, 78 have cam or inclined surfaces 98, 100, respectively, at the upper ends thereof, the function of which will also be explained below.

The vertical portion 102 of the T-shaped member 84 is vertically movably secured to the rear wall 58 of the elevator car 12 by conventional clamping means 104, 106, so that the vertical portion 102 can move up and down, as set forth below. A spring 108 is disposed on the upper part of the vertical position 102 between the transverse portion 82 and the upper clamping means 104 to maintain the T-shaped member 84 in its uppermost position, as set forth below.

The rear end of the connecting portion 56 of the handle 50 is fixedly connected to the center of a cam member 110 so that rotation of the handle 50 will also rotate the cam member 110 in the same direction. The cam member 110 is provided with a substantially U-shaped cam slot 112 in such a manner that the bight portion of the cam slot 112 is closest to the periphery of the cam member 110, and the opposing ends of the legs of the cam slot 112 are closer to the center of the cam member 110. It is noted, that the cam slot 112 is in the upper half of the cam member 110 which preferably has a circular configuration. Accordingly, a pin 114 is fixedly secured to the bottom end of the vertical portion 102 of the T-shaped member 84 in such a manner that the pin 114 extends into the cam slot 112, so that the pin 114 is captured within the cam slot 112, and is moved vertically up and down when the cam member 110 is rotated, as set forth below.

The operation of the opening means 59 will now be described. As shown in FIG. 3, when the overhead panels 24, 26 are in the closed position, the pin 114 is positioned at the bight portion of the cam slot 112, and the spring 108 acts upon the transverse portion 82 of the T-shaped member 84 to insure that the T-shaped member is in its uppermost position. In this position, the cam member 110 can be rotated in either a clockwise or counterclockwise direction.

Accordingly, when required, the handle 50 is rotated by one of the passengers, in this case being rotated counterclockwise in the direction of the arrow 62, as indicated above, which also acts to rotate the cam member 110 in the same counterclockwise direction. As shown in FIG. 4, the pin 114 rides in the cam slot 112 and moves downwardly in the direction of arrow 116 towards the center of the cam member 110. The pin 114 pulls the T-shaped member 84 downwardly with it against the action of the spring 108, so that the bars 74, 78 are also pulled downwardly and out of the openings 76, 80 of the overhead panels 24, 26, respectively, to release the overhead panels 24, 26.

Once the overhead panels 24, 26 are released from the bars 74, 78, the springs 66, 68 act upon the overhead panels 24, 26 to pull the overhead panel 24 to the left side of the elevator car 12 as indicated by arrow 118, and to pull the overhead panel 26 to the right side of the elevator car 12 as indicated by the arrow 120, thereby folding the overhead panels 24, 26 on themselves by the corrugations thereof, and thus opening the overhead compartment 32. The ropes 36A, 36B, 38A, 38B, 40A and 40B will now drop by gravity out of the overhead compartment 32 into the interior space of the elevator car 12, as shown in FIG. 2, and the passengers will proceed in the manner set forth above.

Figure 5:
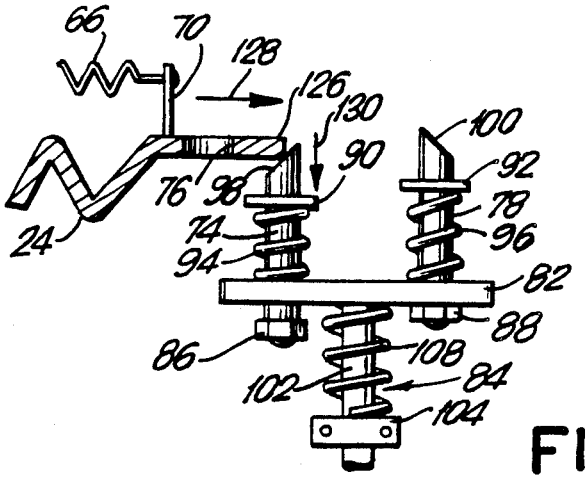
FIG. 5 is a further enlarged fragmented cross-sectional elevational view, showing one of the overhead panels being moved to the closed position relative to the mechanism.

FIG. 5 shows how the overhead panels are closed after the above opening procedure. Preferably, each of the overhead panels 24, 26 is provided with a handle-like member 122, 124, respectively, as shown in FIGS. 1 and 2, positioned on its forward edge to aid in the closing of the overhead panels 24, 26. Accordingly, the handle-like member 122 of the overhead panel 24 is pulled towards the right side of the elevator car 12, and the ropes 36A, 38A and 40A are inserted back into the compartment 32 above the overhead panel 24. The forward end 126 of the overhead panel 24 upon closing, in the direction of the arrow 128 shown in FIG. 5, engages the cam or inclined surface 98 of the bar 74 and pushes the bar 74 downwardly in the direction of arrow 130 against the action of the spring 94.

The bar 74 continues to be pushed downwardly until it reaches the undersurface of the forward end 126, and then the tip portion of the bar 74 rides against this undersurface of the forward end 126 until it is snapped into the opening 76 by the returning force of the spring 94 to the position shown in FIG. 3. The same procedure is followed for closing the other overhead panel 26. It is noted, that during this closing procedure, the spring 108 maintains the T-shaped member 84 in its uppermost position, where only the bars 74, 78 move vertically up and down.

Numerous changes in the structures hereinabove described may suggest themselves to those skilled in the art, however, it is understood that the present disclosure relates to a preferred embodiment of the invention, and is not to be construed as a limitation of the invention.

What is claimed is:

1. A safety device for elevators which can support passengers above a floor of an elevator car, said device comprising:

at least one overhead panel extending across an upper portion of the elevator car to provide an overhead compartment within the elevator car;

a plurality of rope-like means for supporting the passengers above the floor of the elevator car when said one overhead panel is in an opened position;

said rope-like means being stored within said overhead compartment prior to use thereof when said one overhead panel is in a closed position;

each of said rope-like means having one end secured to a roof of the elevator car within said overhead compartment, and having an opposite free end provide with foot means for supporting a passenger's foot;

opening means for opening said one overhead panel so that said rope-like means are released from said overhead compartment and said free ends of said rope-like means with said foot means thereon fall into an internal space of the elevator car occupied by the passengers; and actuating means disposed within the elevator car at a selected position below said one overhead panel within reach of the passengers for actuating said opening means for opening said one overhead panel;

whereby one of the passengers activates said actuating means to actuate said opening means to open said one overhead panel so that said free ends of said rope-like means fall into the internal space of the elevator car to permit the passengers to step into said foot means to raise themselves above the elevator car floor 2. A safety device according to claim 1, wherein said rope-like means have a predetermined length to space said foot means a selected distance above the elevator car floor when said rope-like means fall into the elevator car 3. A safety device according to claim 1, wherein said rope-like means include ropes.

4. A safety device according to claim 3, wherein said foot means are stirrups, there being one stirrup for each of said ropes.

5. A safety device according to claim 4, wherein each of said stirrups is formed from said opposite free end of each associated one of said ropes.

6. A safety device according to claim 1, wherein said foot means are stirrups, there being one stirrup for each of said rope-like means.

7. A safety device according to claim 1, wherein said rope-like means are arranged in pairs, there being one pair of said rope-like means for each passenger.

8. A safety device according to claim 1, wherein there are two openable overhead panels extending transversely from opposite side walls of the elevator car, said two openable overhead panels being releasably joined together at a center of the elevator car.

9. A safety device according to claim 1, wherein said actuating means includes a handle which can be rotated by one of the passengers.

10. A safety device according to claim 1, wherein said opening means includes a spring connected to said one overhead panel for moving said one overhead panel to said opened position.

11. A safety device according to claim 10, wherein bar means maintain said one overhead panel in said closed position against an opening action of said spring.

12. A safety device according to claim 11, wherein said actuating means includes a handle which can be rotated by one of the passengers, and cam means connected between said handle and said bar means so that rotation of said handle causes said cam means to move said bar means to release said one overhead panel therefrom, whereby said spring opens said one overhead panel and said free ends of said rope-like means fall into the internal space of the elevator car.

* * * * *